US005241907A

United States Patent [19]

Dörsam et al.

[11] Patent Number: 5,241,907

[45] Date of Patent: Sep. 7, 1993

[54] SHEET TRANSPORT DRUM WITH SHEET SUCTION HOLDING SURFACE

[75] Inventors: Willi R. L. Dörsam, Höchberg; Johann E. Eitel, Thüngen; Peter E. Wagner, Grünsfeld; Erich G. Wieland, Würzburg, all of Fed. Rep. of Germany

[73] Assignee: Koenig & Bauer Aktiengesellschaft, Würzburg, Fed. Rep. of Germany

[21] Appl. No.: 926,708

[22] Filed: Aug. 10, 1992

[30] Foreign Application Priority Data

Aug. 12, 1991 [DE] Fed. Rep. of Germany ..... 4126643

[51] Int. Cl.[5] ..... B41F 1/30

[52] U.S. Cl. ..... 101/409; 101/415.1; 271/195; 271/276

[58] Field of Search ..... 101/408, 409, 410, 415.1, 101/378, 382 MV; 271/195, 776, 82

[56] References Cited

U.S. PATENT DOCUMENTS

| | | | |
|---|---|---|---|
| 3,986,455 | 10/1976 | Jeschke et al. | 101/409 |
| 4,127,265 | 11/1978 | Wirz et al. | 101/409 |
| 4,357,870 | 11/1982 | Rudolph et al. | 271/276 |
| 4,378,734 | 4/1983 | Wirz | 101/410 |
| 4,852,488 | 8/1989 | Abendroth et al. | 271/276 |
| 5,029,834 | 7/1991 | Boldrini et al. | 271/11 |
| 5,184,553 | 2/1993 | Kobler et al. | 271/276 |
| 5,186,107 | 2/1993 | Wieland | 271/195 |

FOREIGN PATENT DOCUMENTS

| | | |
|---|---|---|
| 1561043 | 3/1967 | Fed. Rep. of Germany . |
| 2419747 | 4/1974 | Fed. Rep. of Germany . |
| 2916251 | 4/1979 | Fed. Rep. of Germany . |
| 3710341 | 3/1987 | Fed. Rep. of Germany . |

*Primary Examiner*—Eugene H. Eickholt
*Attorney, Agent, or Firm*—Jones, Tullar & Cooper

[57] ABSTRACT

A sheet transport drum utilizes a plurality of drum peripheral envelope surface elements which are each secured to spaced apart disks. Each of these drum envelope surface elements has a plurality of vacuum chambers which are supplied with vacuum in a circumferentially sequential manner. A sheet to be transported by the sheet transport drum is smoothly attracted to the drum's outer perforated envelope plate without wrinkling or buckling.

15 Claims, 4 Drawing Sheets

1
2
3
4
6
7
8
9
11
12
13
14
16
17
18
22
23
24
26
27
28
30
A
B

SHEET TRANSPORT DRUM WITH SHEET SUCTION HOLDING SURFACE

FIELD OF THE INVENTION

The present invention is directed generally to a sheet transport drum. More particularly, the present invention is directed to a drum for transporting and transferring sheets. Most specifically, the present invention is directed to a sheet transport drum having a plurality of sheet supporting elements. Each of these sheet supporting elements has a plurality of surface vacuum apertures and a vacuum is applied to each sheet support element in a circumferentially sequential manner. A plurality of support disks or spiders are attached to a central shaft of the sheet transport drum. The sheet supporting elements are carried by the peripheral surfaces of these support disks or spiders and can be released from their supports.

DESCRIPTION OF THE PRIOR ART

Sheet transport and transfer drum assemblies are generally known in the prior art. These drums are used to transport sheets of printed material, typically paper, between various components of a printing press assembly. These sheet transport and transfer drums utilize peripherally carried, axially extending sheet grippers to grasp a leading end of a sheet being transported. Various suction devices are also utilized to adhere the sheet of paper to the surface of the drum and to prevent the sheet from coming off the drum as the drum is caused to rotate.

One prior art sheet transfer drum is shown in German patent specification No. 24 19 747. In this patent there is shown a device which is usable for changing over and adjusting a transfer drum to guide a sheet. The transfer drum disclosed in this document is divided in half and the halves of the outer, enveloping surface of the drum mesh like a comb to provide a size adjusting or setting function. The sheets being transferred are held by sheet grippers at their leading edges and their trailing edges are held by vacuum through the use of suction devices. This prior art sheet guiding drum is particularly useful for changing over the press from single sided printing to perfecting or recto/verso printing.

A limitation of this prior art sheet transfer drum is that it is not certain that the sheets being transported may not wrinkle as they are placed on the surface of the drum. These wrinkles and buckles in the sheets, especially on the trailing edge of the sheet being transported, may not be removed when the sheet is placed on the drum. As a result, the sheets do not lie completely flat on the outer, drum enveloping surface.

It will thus be apparent that a need exists for a sheet transport drum that overcomes the limitations of these prior art devices. The sheet transport drum in accordance with the present invention provides such a device and is a significant improvement over the prior art devices.

SUMMARY OF THE INVENTION

It is an object of the present invention to provide a sheet transport drum.

Another object of the present invention is to provide a drum for transporting and transferring sheets.

A further object of the present invention is to provide a sheet transport drum having a plurality of sheet supporting elements.

Yet another object of the present invention is to provide a sheet transport drum having sheet supporting elements with outer perforated envelope plates.

Still a further object of the present invention is to provide a sheet transport drum in which vacuum is applied to each outer perforated envelope plate in a circumferentially sequential manner.

Even yet another object of the present invention is to provide a sheet transport drum having a plurality of sheet supporting elements which are removably attachable to the drum.

As will be discussed in detail in the description of the preferred embodiments, which are set forth subsequently, the sheet transport drum in accordance with the present invention utilizes a plurality of spaced support disks or spiders which are attached to a central hollow shaft. These support disks are spaced from each other and provide support for several sheet supporting elements or drum envelope surfaces. These drum surfaces form an envelope on the outer periphery of the sheet transport drum. An outer perforated envelope plate is separated from an inner envelope plate by a folded or corrugated plate. A plurality of vacuum lines are attached to each drum envelope surface element and these vacuum lines are in contact with an arcuate, fixed suction chamber. As the sheet transport drum rotates, a vacuum is applied to the outer perforated envelope plate of one of the drum envelope surface elements in a circumferentially sequential manner. This ensures that the sheet being transported will be held against the surface of the sheet transport drum without wrinkles or buckles.

The primary advantage of the sheet transport drum of the present invention lies in its ability to apply a constant suction or vacuum force to the paper sheet even when the sheet is only partially covering the surface of a particular drum envelope surface element. The fact that the chambers in each drum envelope surface element are supplied with vacuum or suction air successively in a circumferential direction allows the sheet to be received and held on the sheet transport drum without creating any wrinkles. The suction chambers in each one of the drum envelope surface elements may be arranged in a generally V-shape. This provides a particularly beneficial smoothing effect on the sheets being transported.

Several of the trailing vacuum lines for each of the drum envelope support elements can be turned off. This allows the size of the suction field created on the envelope surface to correspond with the size of the sheet being transported. This results in a considerable savings in energy.

Each of the drum envelope surface elements is supported by a spring biased clamping assembly. This allows the individual envelope surface elements to deflect slightly and thus avoid possible damage caused by crumpled sheets and multiple sheets that may become attached to the envelope surface elements. If an individual drum envelope surface element should become damaged, it can easily be removed from the support disks or spiders and can be replaced quickly because of the clamping assemblies used. Since the drum envelope surface elements forms an outer shell or envelope for the generally hollow sheet transport drum there are not created as high accelerating and inertial forces on the rotating drum due to its low inertia of masses.

The sheet transport drum in accordance with the present invention overcomes the limitations of the prior art and is a substantial advance in the art.

BRIEF DESCRIPTION OF THE DRAWINGS

While the novel features of the sheet transport drum in accordance with the present invention are set forth with particularity in the appended claims, a full and complete understanding of the invention may be had by referring to the detailed description of the preferred embodiments which are presented subsequently, and as illustrated in the accompanying drawings, in which:

DETAILED DESCRIPTION OF PREFERRED EMBODIMENTS

Figure 1:
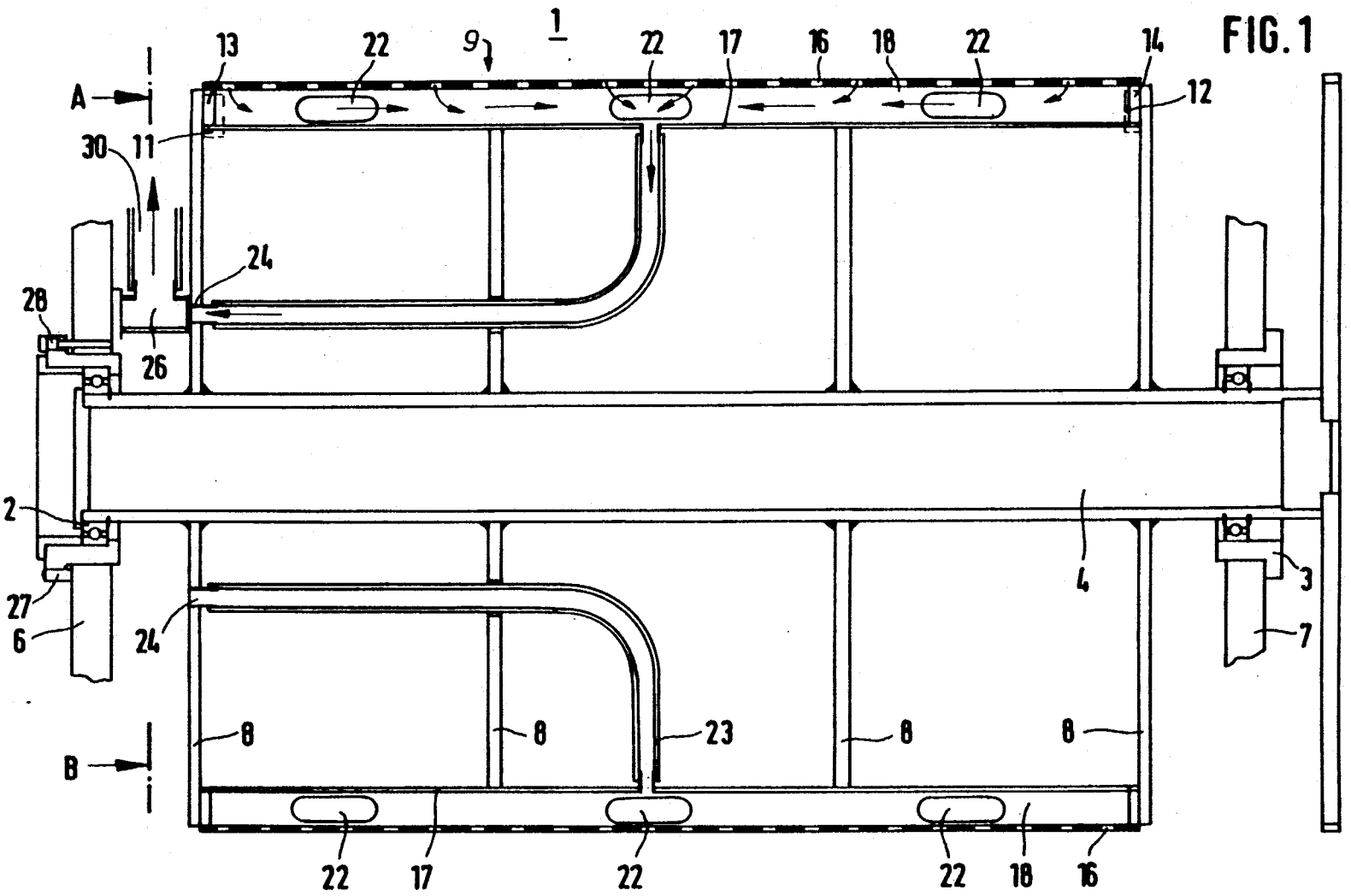
FIG. 1 is a cross-sectional side view of a sheet transport drum in accordance with the present invention and taken along line C—D in FIG. 2.
Figure 2:
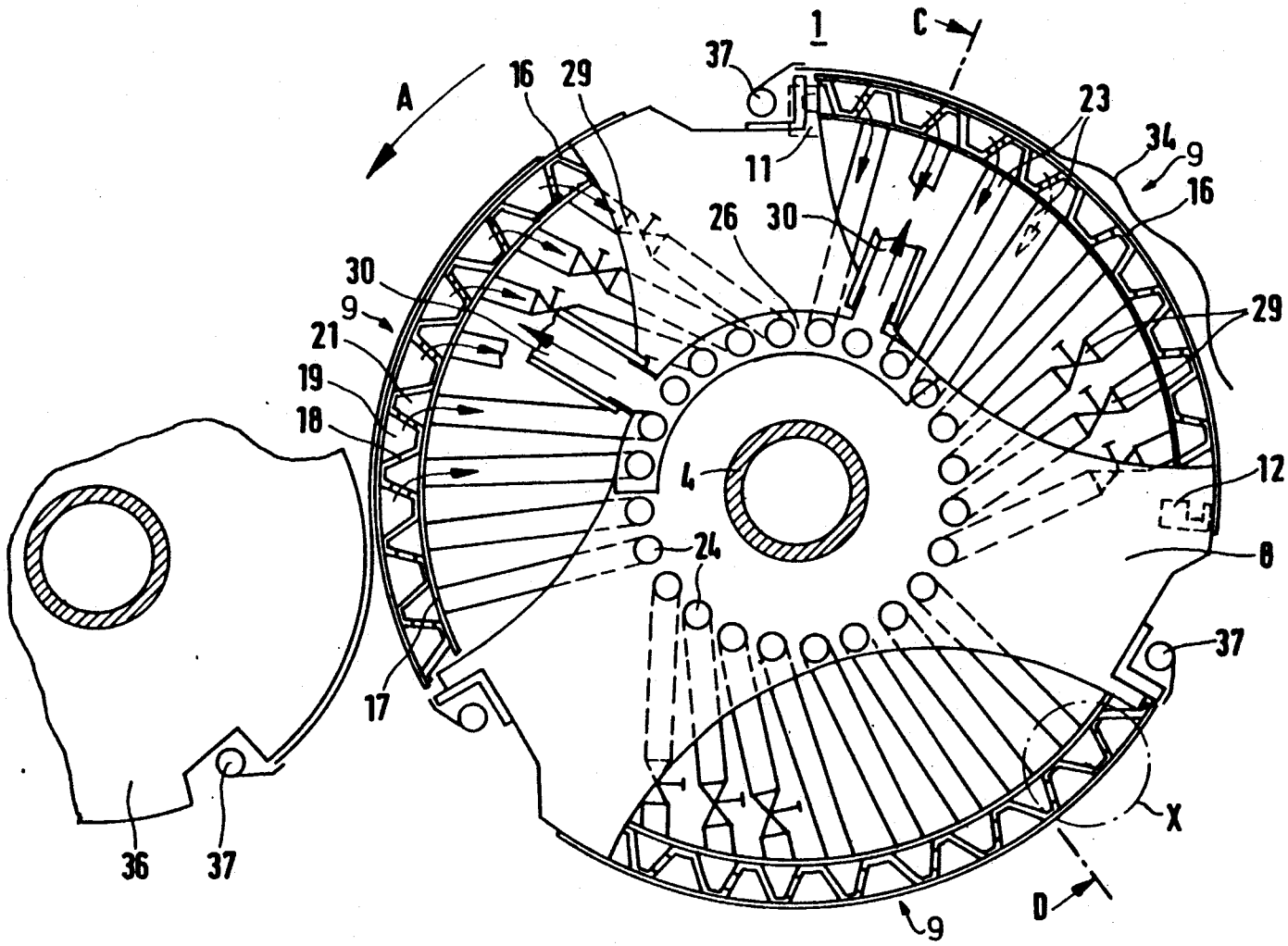
FIG. 2 is a cross-sectional end view of the sheet transport drum taken along line A—B of FIG. 1 with portions of the cheek plates removed for clarity.

Referring initially primarily to FIGS. 1 and 2, there may be seen generally at a first preferred embodiment of a sheet transport drum in accordance with the present invention. Sheet transport drum 1 includes a central, rotatable, hollow shaft 4 which is supported at a first end in a fixed bearing 2 and at a second end in a movable bearing 3. Bearings 2 and 3 are, in turn, supported in side walls 6 and 7, respectively of a press frame. First and second end support disks 8 are secured to hollow shaft 4 adjacent the bearings 2 and 3 and act as end faces for the sheet transport drum 1. At least two intermediate support disks 8 are secured to shaft 4 intermediate the two end support disks 8. These two intermediate support disks 8 are spaced equidistant from each other and from the two end support disks 8. As may be seen most clearly in FIG. 2, these support disks 8 are not solid, or circular disks but are instead shaped as support spiders or stars and have recesses extending inwardly from their peripheries toward the hollow shaft 4.

Figure 4:
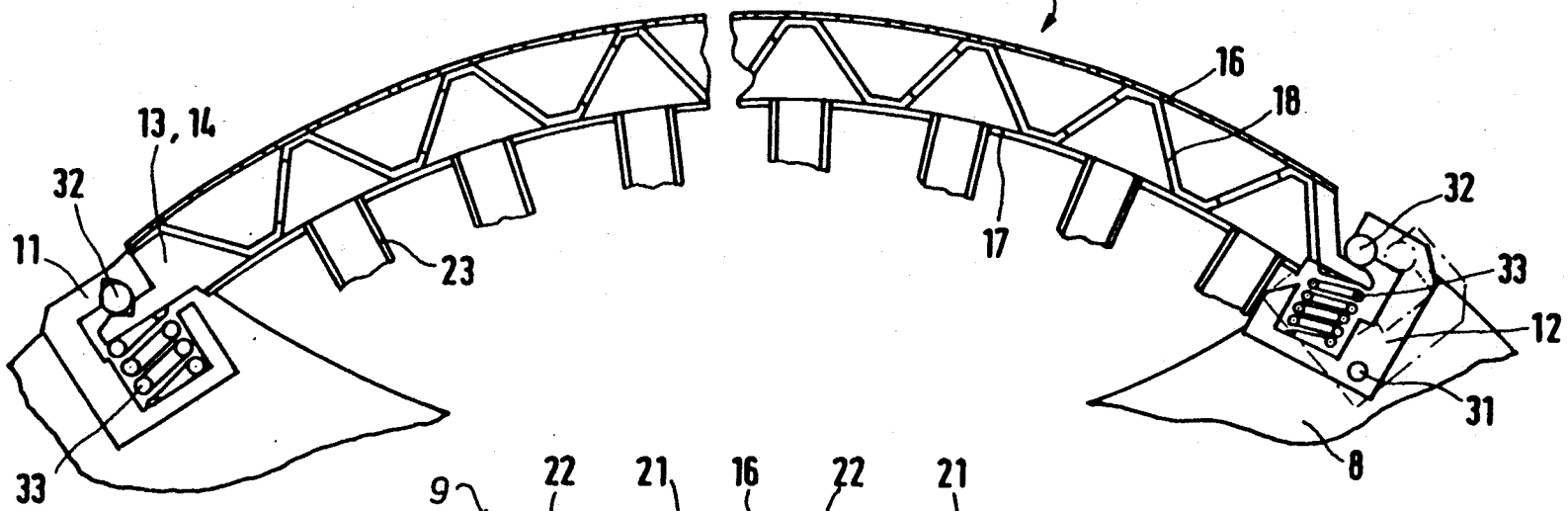
FIG. 4 is an enlarged view of one of the drum envelope surface elements and its supports of FIG. 2.

As may be seen most clearly in FIGS. 2 and 4 the sheet transport drum 1 has a outer surface that is formed by three drum envelope surface elements 9 or supporting elements 9. These drum envelope surface elements 9 form a support surface or envelope that is the periphery of the sheet transport drum 1. Each of these drum envelope surface elements 9 has cheek plates 13 and 14 at its axially spaced ends. These cheek plates 13 and 14 are shaped as circular segments having a radius the same as the radius of the sheet transport drum 1. These cheek plates 13 and 14 are both securely attachable to radially outer ends of the end face forming support disks 8 by supporting members or clamps 11 and 12 whose structure and operation will be discussed in detail subsequently.

Each of the drum envelope surface elements 9 is lightweight in its construction and, as seen in FIGS. 1–4 includes an outer perforated envelope plate 16, an inner envelope plate 17 and an intermediate folded or corrugated plate or web 18. This corrugated web 18 forms a plurality of axially extending chambers 19 and 21 in the drum envelope surface element 9 which are in fluid communication with each other by means of recesses or ports 22 in the walls of the corrugated web 18. The chambers 19 and 21 are closed and sealed at their ends by the cheek plates 13 and 14, portions of which have been omitted in FIGS. 2, 3 and 4 for the sake of clarity. Each of these chambers 19 and 21 extends axially across the circumference of its respective drum envelope surface element 9.

Figure 3:
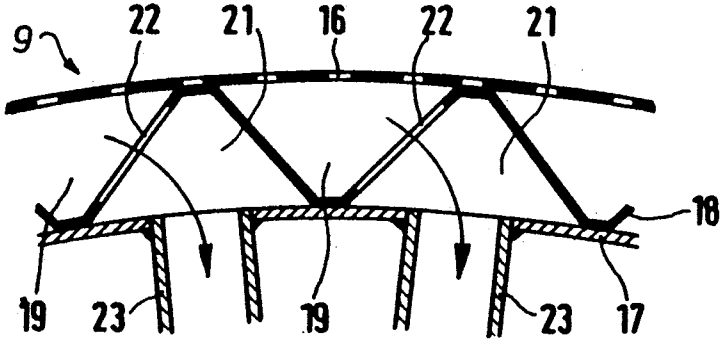
FIG. 3 is a detail view of the encircled portion indicated at X in FIG. 2.

Each of the inner chambers 21 is provided with a radially inwardly extending suction line 23, as may be seen most clearly in FIG. 3. Each of the outer chambers 19 is provided with a plurality of perforations that cooperate to form the perforated surface of the outer perforated envelope plate 16 of each drum envelope surface element 9. These suction lines 23 may be suitable hoses which, as may be seen in FIG. 1 are positioned between the two intermediate supporting disks 8. These suction hoses 23 first extend radially inwardly from the inner envelope plate 17 of each drum envelope surface element 9 toward the central hollow shaft 4. They then pass through suitable apertures in one of the intermediate support disks 8 and are connected to suction openings 24 in the end support disk 8 which is situated adjacent the fixed bearing 2. As may be seen in FIG. 2, this plurality of suction openings 24 in the end support disk 8 form a ring of suction openings 24 which is concentric with, and spaced between the central hollow support shaft 4 and the peripheral drum envelope surface elements 9.

A suction chamber 26 is, as may be seen in FIGS. 1 and 2 formed as a segment of a circle having the same radius as the ring of suction openings 24. This suction chamber 26 extends through an arc of about 140° and is secured to the side wall 6 of the press assembly. The fixed bearing 2, which is securely attached to the end of the hollow shaft 4 adjacent the side wall 6 of the press frame, is provided with an adjusting set screw 27 and is secured by a locking screw 28 so that the air gap between the ring of suction openings 24 and the suction chamber 26 can be adjusted. The suction chamber 26 is provided with two circumferentially spaced suction air connections 30 which are connected to a suitable vacuum pump or other suction generator which is not specifically shown.

In operation, as a suction is applied to the suction chamber 26 through the suction connections 30, a similar suction is applied through the circular segment of the suction openings 24 which become adjacent the suction chamber 26 as the sheet transport drum rotates in the direction indicated by large arrow A in FIG. 2. This suction passes through the suction lines 23 attached to the corresponding suction openings 23 and evacuates the inner chambers 21 in the corresponding drum envelope surface element 9. The vacuum created in each inner chamber 21 in turn creates a vacuum in the adjacent outer chamber 19 due to the vacuum ports or recesses 22 in the intermediate corrugated web 18. This vacuum thus forms a vacuum at the outer surface of the outer perforated envelope plate 16. Since the sheet transport drive is rotating in the direction indicated by the large arrow A in FIG. 2, and further since each drum envelope surface element 9 has a sheet gripper assembly 37 at its leading end, the vacuum created adjacent the outer perforated envelope plate 16 starts initially adjacent the sheet gripper 37 and move circumferentially in a direction opposite to the direction of rotation of the sheet transport drum 1. This ensures that a sheet 34 which is fed to the sheet transport drum 1 and which is gripped by the sheet grippers 37 of one of the drum envelope surface elements 9 will be pulled against the outer surface of the outer perforated envelope plate in a circumferentially sequential manner. The last several suction lines 23 for each drum envelope surface element 9 are, as may be seen in FIG. 2, provided with suitable stop valves 29. This will allow the suction lines 23 which may not be required to provide suction to the inner chambers 21 and hence to the outer chambers 19 at the trailing end of the drum envelope surface element 9 to be shut off if the sheet of paper 34 is not long enough to overlie that portion of the outer perforated envelope plate 16.

Referring again to FIG. 4, the drum envelope surface elements 9 are attached at their circumferential ends to the end supporting disks 8 by support parts or clamps 11 and 12 as was alluded to previously. The leading support clamp 11 may be fixedly secured to outer or end support disks 8 while the trailing support clamp 12 may be pivotably attached to the end support disks 8 by a pivot axis 31. This pivotable trailing support clamp 12 provides a quick release so that a damaged drum envelope surface element 9 can be quickly removed and replaced by an operable one. Each end of each check plate 13 and 14 has a circumferentially extending tongue which includes a ball seat. When each such tongue is inserted into its associated support clamp 11 or 12, a ball 32 is received in the ball seat which is biased against the ball by a suitable pressure spring 33. In the sheet transport drum i depicted in FIG. 2, only the leading edge of each drum envelope surface element 9 is shown as being held by a fixed, leading end support clamp 11 whereas in the sheet transport drum 1 shown in FIG. 4 the trailing edge of the drum envelope surface element 9 is shown as being held by a pivotable trailing end support clamp 12 in addition to fixed, leading end support clamp The use of these spring biased clamps 11 and 12 allows the drum envelope surface elements 9 to be somewhat resiliently supported so that they can move radially inwardly to avoid damage that would otherwise be possible due to the presence of multiple sheets or possibly crumpled sheets or other foreign bodies.

As was discussed previously, as the sheet transport drum 1 rotates in the direction indicated by large arrow A in FIG. 2, the leading edge of a sheet 34 to be transported is grasped by sheet grippers 37 at the leading edge of the drum envelope surface element 9. The sheet is smoothly secured to the outer perforated envelope plate by the sequential application of vacuum to the individual ones of the suction openings 24 which move into position adjacent the suction chamber 26. In this first preferred embodiment of the sheet transport drum 1 in accordance with the present invention, the vacuum flow is generally axially straight across the drum envelope surface element 9 as each axially extending inner and outer chamber 21 and 19 is evacuated. The sheet 34 is transported to a transfer drum 36 which, as may be seen in FIG. 2, is also provided with suitable sheet grippers 37.

Figure 5:
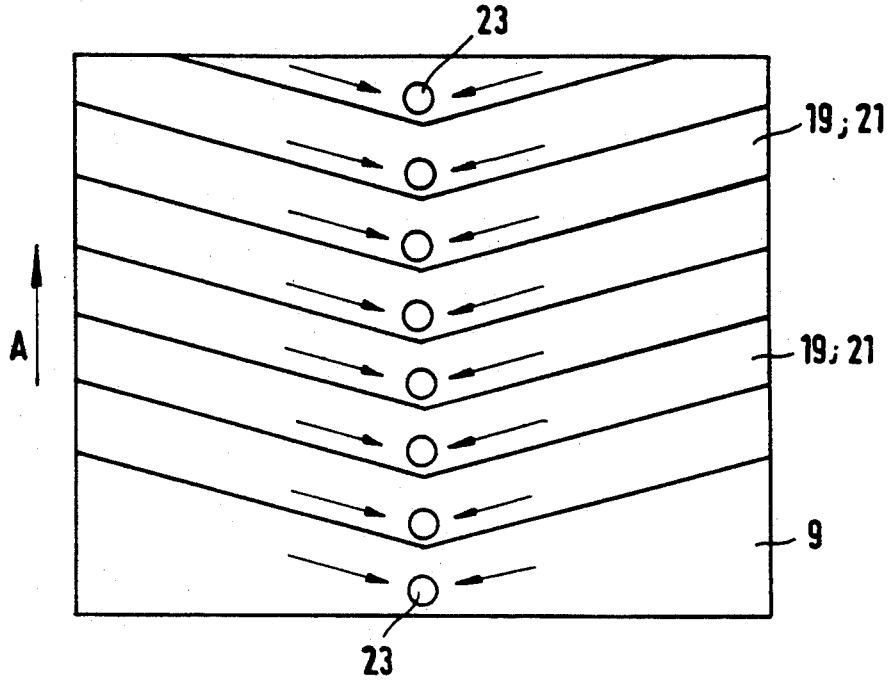
FIG. 5 is a schematic depiction of a second preferred embodiment of the arrangement of the suction air chambers.

Turning now to FIG. 5, a second preferred embodiment of one of the drum envelope surface elements 9 in accordance with the present invention, is depicted in a schematic fashion. In this second preferred embodiment, the chambers 19 and 21 are arranged to form a generally V-shaped array with the apex of each V being adjacent one of the suction lines 23. The plurality of V-shaped chambers point generally opposite to the direction of sheet transport drum rotation which is indicated by the large arrow A in FIG. 5. The plurality of small arrows in FIG. 5 indicate the direction of vacuum flow in a manner similar to that indicated by the small arrows in FIGS. 1, 2, and 3.

Figure 6:
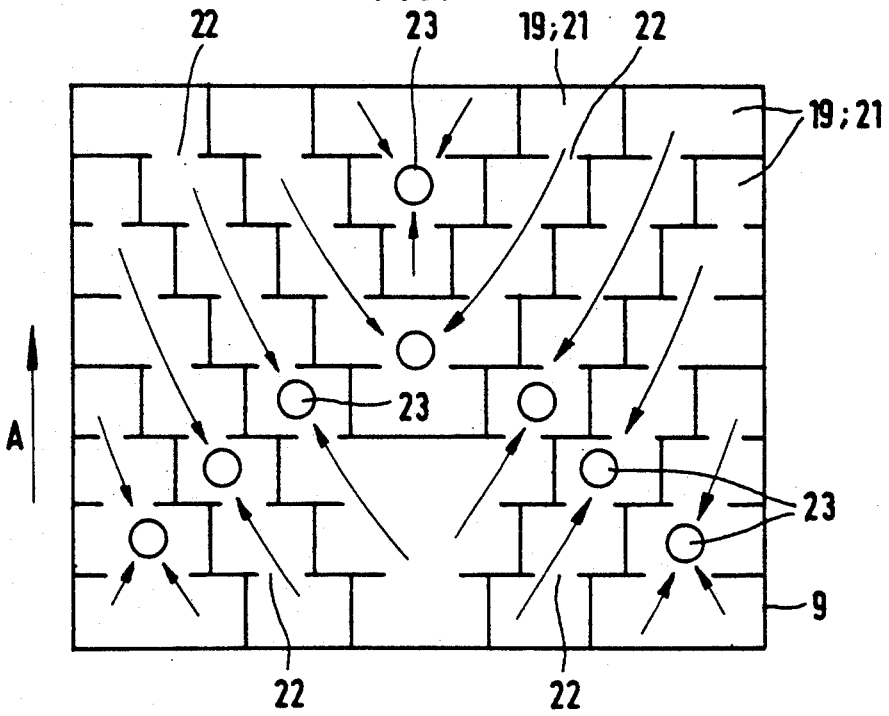
FIG. 6 is a schematic depiction of a third preferred embodiment of the suction air chambers of the present invention.

A third embodiment of one of the drum envelope surface elements 9 in accordance with the present invention is depicted schematically in FIG. 6. In this third embodiment, the chambers 19 and 21 are defined by generally step-shaped baffle plates, as seen in the plan view of FIG. 6. The plurality of suction lines 23 are arranged in a generally Y-shaped arrangement with the leg of the Y extending in the sheet transport direction indicated by large arrow A and with the arms of the Y spreading axially outwardly and toward the rear or trailing edge of the drum envelope surface element 9. This configuration provides a lateral smoothing effect to a sheet 34 which is transported by a sheet transport drum 1 having drum envelope surface elements 9 with this third preferred embodiment arrangement of suction channels 19 and 21. As with the prior two preferred embodiments, the direction of suction application is indicated by the small arrows in FIG. 6.

While preferred embodiments of a sheet transport drum in accordance with the present invention have been set forth fully and completely hereinabove, it will be apparent that changes in, for example, the overall size of the sheet transport drum, the means for providing the vacuum, the type of sheet grippers used and the like can be made without departing from the true spirit and scope of the present invention which is accordingly to be limited only by the following claims.

We claim:

1. A sheet transport drum comprising:

a central rotatably supported shaft;

a plurality of spaced support disks secured to said central shaft;

a plurality of drum envelope surface forming elements secured to said plurality of support disks and defining an outer periphery of said sheet transport drum;

a plurality of suction chambers formed in each of said drum envelope surface forming elements; and means to evacuate said plurality of suction chambers in each of said drum envelope surface elements in a circumferentially sequential manner during rotation of said sheet transport drum.

2. The sheet transport drum of claim 1 wherein at least two of said support disks have radially inwardly directed recesses on their circumferences.

3. The sheet transport drum of claim wherein said plurality of support disks include two end support disks which form ends of said transport drum and further wherein each of said drum envelope surface elements is secured to said end disks by support clamps.

4. The sheet transport drum of claim wherein said plurality of suction chambers are formed by an outer perforated envelope plate, an inner envelope plate and an intermediate corrugated web which spaces said outer plate and said inner plate.

5. The sheet transport drum of claim 4 wherein said plurality of suction chambers are in fluid communication through ports in said corrugated web.

6. The sheet transport drum of claim wherein said plurality of suction chambers are arranged in an axial direction of said sheet transport drum.

7. The sheet transport drum of claim 1 wherein said means to evacuate said plurality of suction chambers includes a plurality of suction lines.

8. The sheet transport drum of claim 7 wherein said plurality of suction lines terminate in a ring of suction openings in one of said support disks.

9. The sheet transport drum of claim 8 further including a suction chamber shaped as a segment of a circle, said suction chamber being positioned adjacent said ring of suction openings.

10. The sheet transport drum of claim 9 wherein said suction chamber includes at least one vacuum connection to a vacuum supply.

11. The sheet transport drum of claim 1 wherein said shaft is rotatably supported in a fixed bearing at a first end and in a movable bearing at a second end and further wherein said fixed bearing is adjustable by use of a setscrew.

12. The sheet transport drum of claim 7 wherein at least some of said suction lines include stop valves.

13. The sheet transport drum of claim 3 wherein a first of said support clamps on each of said end disks is a fixed support clamp and further wherein a second of said support clamps on each of said end disks is pivotable about a pivot axis.

14. The sheet transport drum of claim 3 wherein each of said support clamps includes a ball seat and a pressure spring.

15. The sheet transport drum of claim wherein said plurality of suction chambers are generally V-shaped.

* * * * *

UNITED STATES PATENT AND TRADEMARK OFFICE

CERTIFICATE OF CORRECTION

PATENT NO. : 5,241,907
DATED : September 7, 1993
INVENTOR(S) : Willi R. L. Dorsam, et. al.

It is certified that error appears in the above-indentified patent and that said Letters Patent is hereby corrected as shown below:

Column 6, Claim 3, line 59, after the word "claim" insert --1--.
Column 6, Claim 4, line 64, after the word "claim" insert --1--.
Column 7, Claim 6, line 5, after the word "claim" insert --1--.
Column 8, Claim 15, line 19, after the word "claim insert --1--.

Signed and Sealed this

Twenty-second Day of February, 1994

*Attest:*

Bruce Lehman

BRUCE LEHMAN

*Attesting Officer*

*Commissioner of Patents and Trademarks*